US007159507B2

(12) United States Patent
Grollimund et al.

(10) Patent No.: US 7,159,507 B2
(45) Date of Patent: Jan. 9, 2007

(54) PISTON PUMP USEFUL FOR AEROSOL GENERATION

(75) Inventors: Gary Everett Grollimund, Chesterfield, VA (US); Donald Lee Brookman, Richmond, VA (US); Kenneth A. Cox, Powhatan, VA (US); Walter Allen Nichols, Chesterfield, VA (US); Edwin Waldbusser, Chesterfield, VA (US)

(73) Assignee: Philip Morris USA Inc., Richmond, VA (US)

( * ) Notice: Subject to any disclaimer, the term of this patent is extended or adjusted under 35 U.S.C. 154(b) by 0 days.

(21) Appl. No.: 10/790,753

(22) Filed: Mar. 3, 2004

(65) Prior Publication Data

US 2005/0132879 A1 Jun. 23, 2005

Related U.S. Application Data

(60) Provisional application No. 60/531,623, filed on Dec. 23, 2003.

(51) Int. Cl.
*F01B 3/00* (2006.01)

(52) U.S. Cl. ..... 92/31; 91/233; 417/492

(58) Field of Classification Search ..... 92/31; 91/233; 417/492, 500
See application file for complete search history.

(56) References Cited

U.S. PATENT DOCUMENTS 1,244,160 A * 10/1917 Anderson ..... 91/233
1,326,889 A * 12/1919 Anderson ..... 417/500
1,866,217 A 7/1932 Mayer
2,215,827 A 9/1940 Ditto
2,369,345 A * 2/1945 Folke ..... 417/500
2,424,943 A 7/1947 Nicolls
3,447,468 A * 6/1969 Kinne ..... 91/233
3,900,138 A 8/1975 Phillips
4,099,548 A 7/1978 Sturm et al.
4,465,440 A 8/1984 Thomsen et al.
4,508,273 A 4/1985 Firey (Continued)

FOREIGN PATENT DOCUMENTS

GB 741 455 A 12/1955

OTHER PUBLICATIONS

Notification of Transmittal of the International Search Report and the Written Opinion of the International Searching Authority, or the Declaration dated May 20, 2005 for PCT/US2004/041763.

*Primary Examiner*—Igor Kershteyn
(74) *Attorney, Agent, or Firm*—Buchanan Ingersoll & Rooney PC

(57) ABSTRACT

A piston pump delivers precise and repeatable volumes of a fluid from a reservoir to a downstream component, and includes a piston that is rotatably and reciprocally mounted within a cylinder. The outer periphery of the piston forms an interference fit with the inner periphery of the cylinder. At least one groove is formed in the outer periphery of the piston, with the groove defining a precise volume between the piston and the cylinder, and extending in an axial direction of the piston. The cylinder includes an inlet port for providing fluid communication between a reservoir and the at least one groove when the piston is in a first position, and an exit port circumferentially spaced from the inlet port for providing fluid communication between the at least one groove and a downstream component when the first piston is rotated to a second position where the at least one groove is aligned with the exit port.

26 Claims, 11 Drawing Sheets

U.S. PATENT DOCUMENTS 4,801,253 A 1/1989 Johansson
4,941,809 A 7/1990 Pinkerton
5,020,980 A 6/1991 Pinkerton
5,221,025 A 6/1993 Privas
5,236,314 A 8/1993 Nagashima
5,277,341 A 1/1994 Privas
5,312,233 A * 5/1994 Tanny et al. ..... 417/492
5,366,122 A 11/1994 Guentert et al.
5,388,572 A 2/1995 Mulhauser et al.
5,472,320 A 12/1995 Weisbrodt
5,482,448 A 1/1996 Atwater et al.
5,494,420 A 2/1996 Mawhirt et al.
5,546,932 A 8/1996 Galli
5,601,421 A * 2/1997 Lee ..... 417/492
5,740,794 A 4/1998 Smith et al.
5,741,126 A 4/1998 Stearns et al.
6,540,486 B1 4/2003 Amsler et al.
6,543,448 B1 4/2003 Smith et al.
6,557,552 B1 5/2003 Cox et al.
6,640,050 B1 10/2003 Nichols et al.
2003/0056791 A1 3/2003 Nichols et al.

* cited by examiner

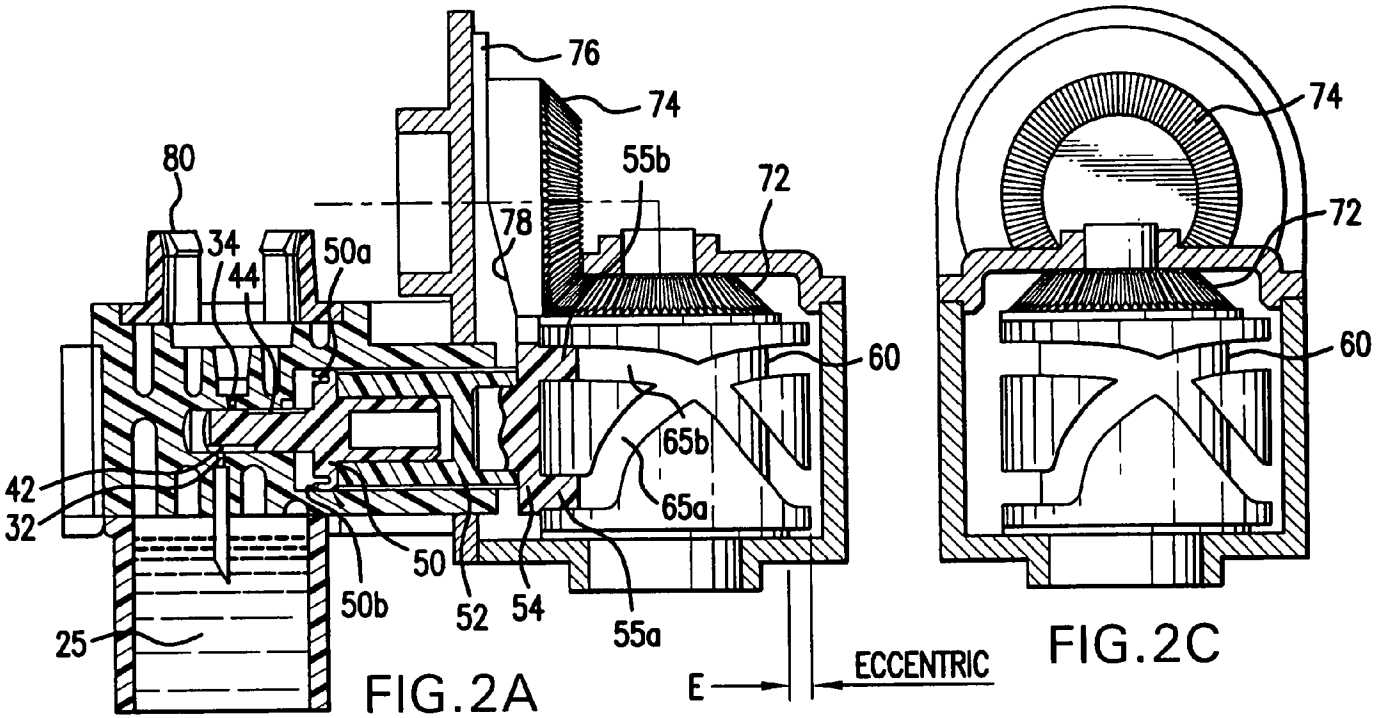
FIG. 2C
FIG. 2A
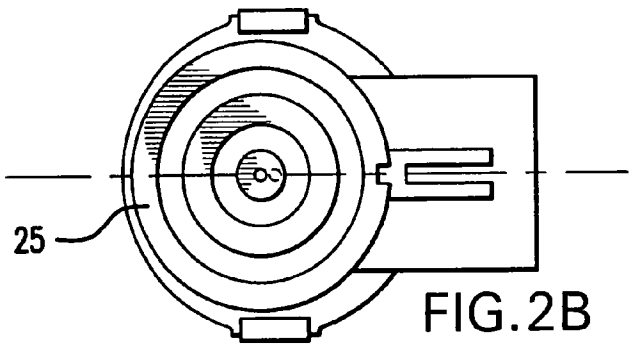
FIG. 2B

PISTON PUMP USEFUL FOR AEROSOL GENERATION

This application claims priority under 35 USC §119 to U.S. Provisional Application No. 60/531,623 entitled PISTON PUMP USEFUL FOR AEROSOL GENERATION and filed on Dec. 23, 2003, the entire content of which is hereby incorporated by reference.

BACKGROUND

Valveless, positive displacement metering pumps are disclosed in U.S. Pat. Nos. 6,540,486, 5,741,126, 5,020,980, 4,941,809, 3,447,468 and 1,866,217.

SUMMARY

According to one embodiment, a device for repeatedly transferring a precise quantity of a fluid from a reservoir to a downstream component includes a first piston rotatably and reciprocally mounted within a first cylinder, with the outer periphery of the first piston forming an interference fit with the inner periphery of the first cylinder. At least one groove is formed in the outer periphery of the first piston, with the groove extending in an axial direction of the first piston. The first cylinder has an inlet port for providing fluid communication between a reservoir and the at least one groove when the first piston is in a first position, and an exit port spaced from the inlet port for providing fluid communication between the at least one groove and a downstream component when the first piston is rotated to a second position and said piston moves to drive fluid out of said outlet. The size or cross sectional area of the groove in a plane perpendicular to the central longitudinal axis of the piston controls the flow of the fluid through the groove from the reservoir and from the space between the end of the piston and the cylinder to the downstream component.

In a preferred embodiment, the piston is dimensioned to provide the interference fit within the cylinder, thereby eliminating the need for any separate shaft seals in order to achieve a fluid tight seal between the piston and the cylinder. The feature of an interference fit between the piston and cylinder also enables a fluid tight seal at higher fluid pressures than possible with separate shaft seals. The piston can also travel all the way to one end of the cylinder during a stroke of the piston such that any trapped air is substantially eliminated during a priming cycle of the device. The interference fit between the piston and cylinder, and the small cross-sectional area of the fluid groove enables a desirable minimization of entrapped air that could affect the accuracy and repeatability of the quantities of fluid dispensed during each cycle of the piston pump.

In one embodiment, the piston is stepped with a larger diameter portion of the piston fitting within a larger diameter portion of the cylinder to form an air chamber between the piston and the shoulder where the larger diameter cylinder meets the smaller diameter cylinder. A first axial groove can be formed in the outer periphery of the smaller diameter portion of the piston at a first circumferential position, and a second axial groove can be formed in the outer periphery of the smaller diameter portion of the piston at a second circumferential position different from the first position. The air chamber defined between the larger diameter portion of the piston and the larger diameter portion of the cylinder can be in fluid communication with one of the grooves in the outer periphery of the piston when that groove is also in fluid communication with the exit port from the cylinder. This groove is an air purge groove that can provide for purging or flushing of the exit port. In a preferred embodiment, the air purge can be used to clear a heated capillary flow passage of a hand held inhaler.

In the embodiment wherein two circumferentially spaced, axial grooves are provided along the outer periphery of the piston, the grooves can extend in the axial direction of the piston, parallel to the central longitudinal axis of the piston. One of the grooves communicates with the inlet port to the cylinder and receives fluid from the reservoir through the inlet port during a suction stroke of the piston, and then communicates with the exit port of the cylinder upon rotation of the piston to bring the groove into alignment with the exit port. This fluid delivery groove extends in the axial direction part way along the outer periphery of the piston from one end of the piston. A precise quantity of fluid trapped between the end of the smaller diameter portion of the piston and the closed end of the cylinder can be dispensed from the exit port after the piston has been rotated to move the fluid delivery groove out of alignment with the inlet port and bring the fluid delivery groove into communication with the exit port or, in one embodiment, aligned with the exit port. During the fluid delivery or dispensing stroke of the piston, the piston is moved forward in the cylinder until the end of the smaller diameter portion of the piston reaches the closed end of the cylinder. The fluid trapped between the end of the piston and the closed end of the cylinder is forced through the groove and is expelled from the exit port of the cylinder. The very small cross sectional area of the groove on the outer periphery of the piston taken in a plane perpendicular to the central axis of the piston controls the flow of the fluid from the chamber formed between the end of the piston and the closed end of the cylinder, and through the groove to the exit port of the cylinder.

In an embodiment wherein a second circumferentially spaced axial groove is also provided on the outer periphery of the piston, and wherein an air chamber is formed between a larger diameter portion of the piston and a larger diameter portion of the cylinder, the dispensing stroke of the piston also results in compression of the air within the air chamber defined between the larger diameter portion of the piston and the larger diameter portion of the cylinder. After the fluid within the chamber formed between the end of the smaller diameter portion the piston and the closed end of the cylinder is dispensed from the exit port of the cylinder, the piston can be rotated in order to bring the second circumferentially spaced air purge groove into alignment with the exit port. As a result, the compressed air within the air chamber then communicates through the second circumferentially spaced groove to the exit port of the cylinder, and can purge any fluid remaining in the exit port. As an alternative to a groove in the outer periphery of the piston for a compressed air purge, a flat or other configuration recess could be provided on the outer periphery at a circumferentially spaced position from the first fluid delivery groove. The width of the flat or recess could be selected to be wider than the diameter of the exit port such that compressed air within the air chamber communicates through the flat or recess to the exit port over a greater arc as the piston is rotated. The air purge groove can be circumferentially spaced from the fluid delivery groove at any number of different positions around the outer periphery of the smaller diameter portion of the piston.

BRIEF DESCRIPTION OF THE DRAWINGS

FIG. 2A shows another cross sectional view of the embodiment shown in FIG. 1.

FIG. 2B shows an end view of the embodiment shown in FIG. 2A.

FIG. 2C shows a side view of the embodiment shown in FIG. 2A.

DETAILED DESCRIPTION

Fluid delivery of precise quantities of fluid is desirable in various applications such as aerosol delivery of medicament containing formulations, medical research applications wherein precise quantities of liquids are added to petri dishes or other equipment, industrial or research applications wherein precise volumes of liquids are needed, medical equipment wherein precise volumes of medications are introduced into the blood stream through intravenous injection, or the like. A drawback of commercially available fluid delivery devices is the potential for trapped air to become entrained in the delivered liquid and/or variability in volume of liquid delivered per pump actuation.

Figure 1:
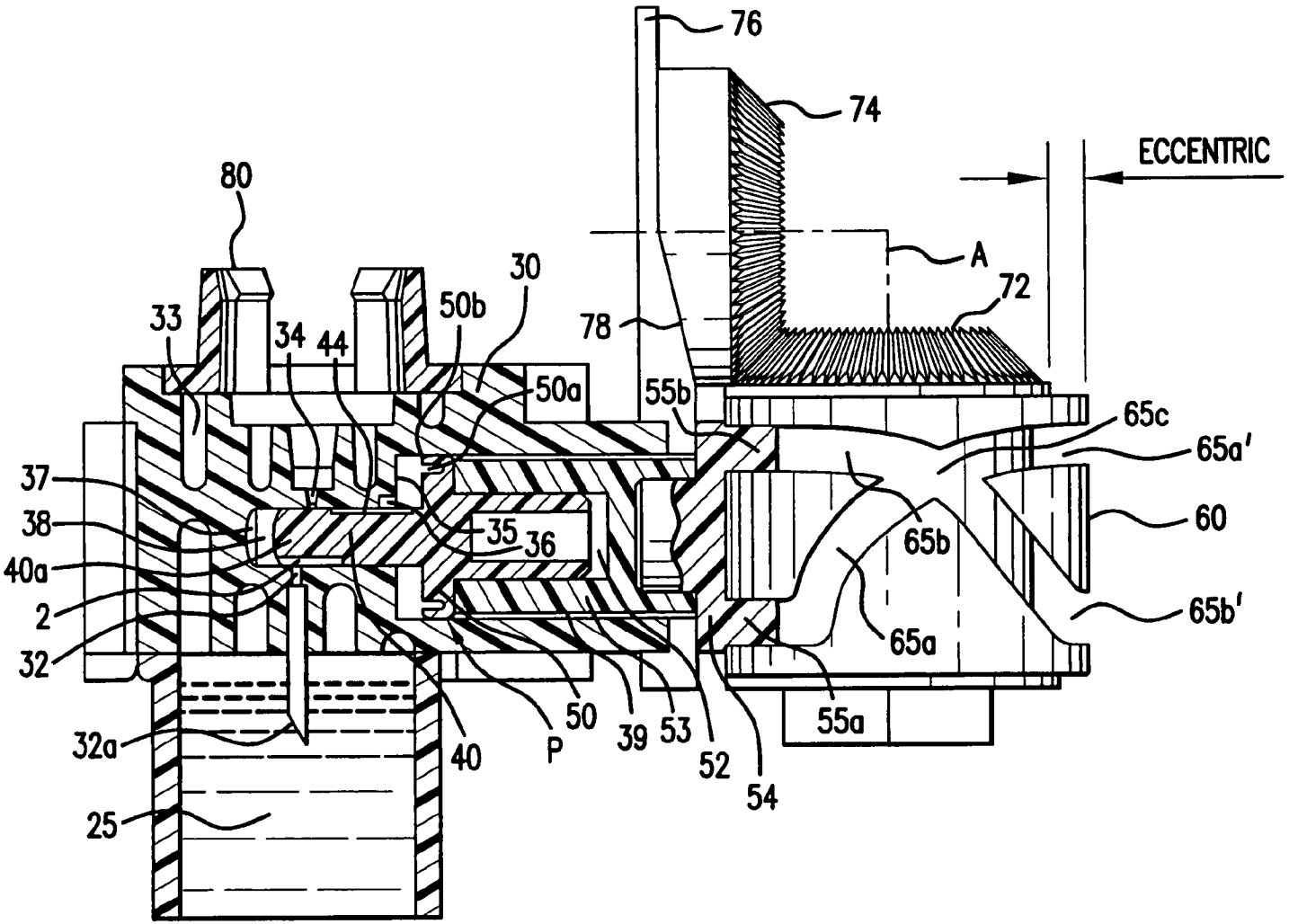
FIG. 1 is a cross sectional view of a device according to one embodiment, showing a stepped piston having two circumferentially spaced grooves and a barrel cam arrangement for rotating and reciprocating the piston.

A preferred embodiment of a device that can accurately and repeatably meter a single volume of liquid over a wide range of temperatures and liquid viscosities is illustrated in FIGS. 1–6. Referring initially to FIG. 1, a piston pump device is provided in fluid communication with a reservoir containing a liquid and a downstream component, such as an aerosol device or micro arrays of fluid receptacles used, e.g., in DNA testing or other test setups requiring a large number of repeatably precise dispensed samples. The piston of the piston pump device can be rotated and reciprocated by an eccentric barrel cam device. A preferred piston is a stepped piston having a smaller diameter portion that mates with an interference fit in a smaller diameter cylinder and can be rotated and reciprocated within the cylinder. The coaxial, larger diameter portion of the piston fits within a larger diameter cylinder, and defines an air chamber between the larger diameter portion of the piston and the shoulder between the larger diameter cylinder and the smaller diameter cylinder. However, while an eccentric barrel cam is shown as a device for rotating and reciprocating the piston within the cylinder, it will be understood by one of ordinary skill in the art that a variety of other mechanical and/or electromechanical arrangements could be used to rotate and reciprocate the piston.

The cylinder within which the stepped piston rotates and reciprocates, includes an inlet port and an exit port. The inlet port may be in fluid communication with a reservoir for storing the fluid that is to be dispensed by the piston pump, and the exit port may be in fluid communication with a downstream component. A preferred downstream component is a heated capillary flow passage of an aerosol generator. An example of an aerosol generator which can utilize the piston pump described herein to deliver precise volumes of liquid medicament to a heated capillary passage can be found in commonly-owned U.S. Pat. Nos. 6,640,050 and 6,557,552, the disclosures of which are hereby incorporated herein in their entireties by reference.

Figure 7A:
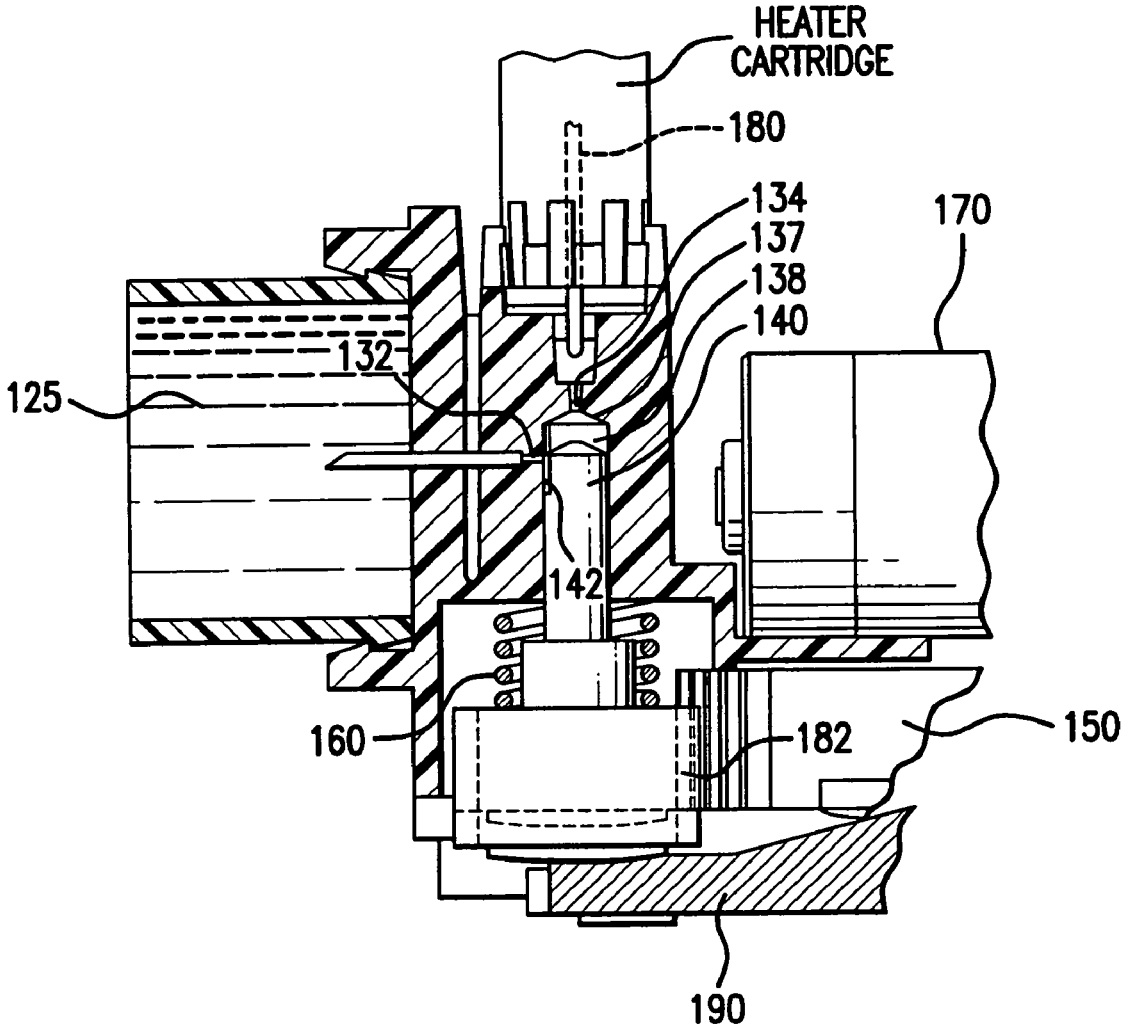
FIG. 7A illustrates an alternative embodiment of the piston pump with a rack, gear and cam arrangement for rotating and reciprocating the piston.
Figure 7B:
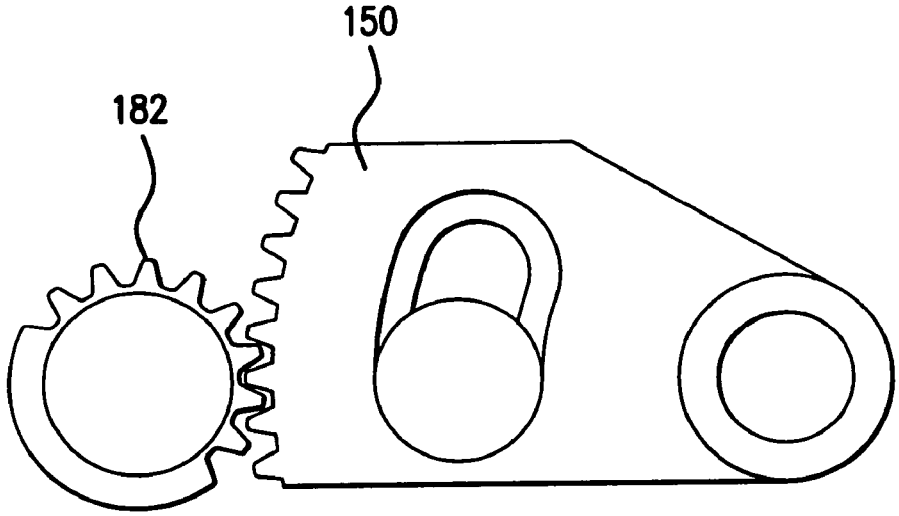
FIG. 7B illustrates the rack and gear portion of the embodiment shown in FIG. 7A
Figure 8A:
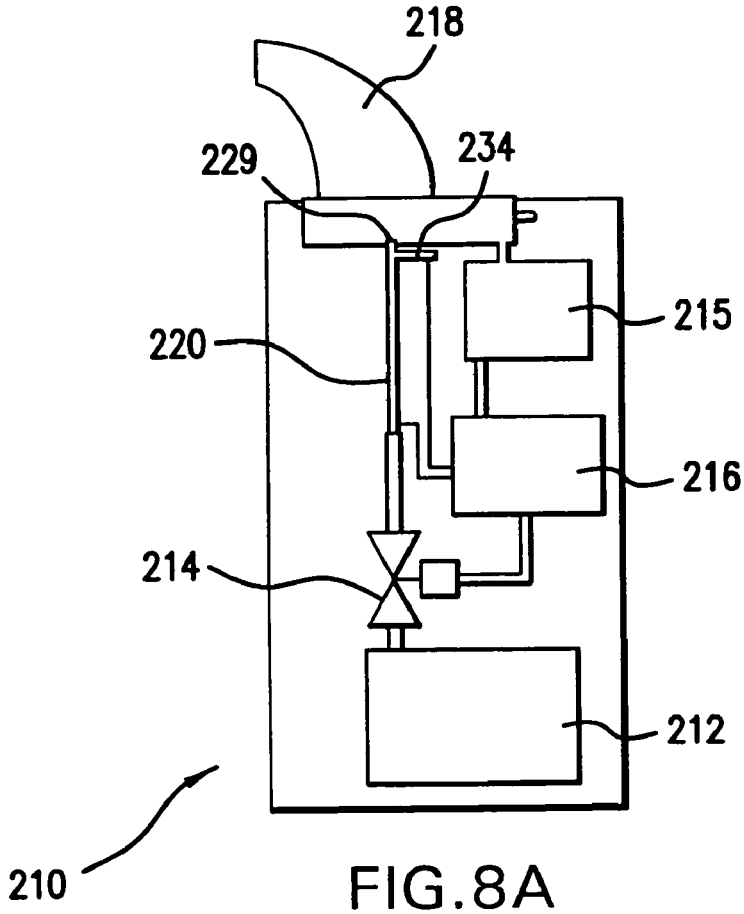
FIG. 8A illustrates a fluid vaporizing device that could receive fluid in controlled amounts from a piston pump.

FIG. 8A illustrates an exemplary aerosol generator 210 which includes a source of fluid 212, which can be delivered by the piston pump shown in FIGS. 1–7. For example, a piston pump 214 can be used to deliver a precise volume of liquid from reservoir 212 to a heated capillary flow passage 220 which vaporizes the liquid and forms an aerosol as the vapor exits an outlet of the flow passage 220. A mouthpiece 218 can deliver the aerosol to a user. The mouthpiece forms part of a hand held inhaler which includes a breath actuated sensor 215 and controller 216. The controller 216 effects supply of power from a power source such as one or more batteries to operate the pump 214, and heat the capillary flow passage 220, thereby volatilizing the fluid passing through the flow passage 220.

Figure 8B:
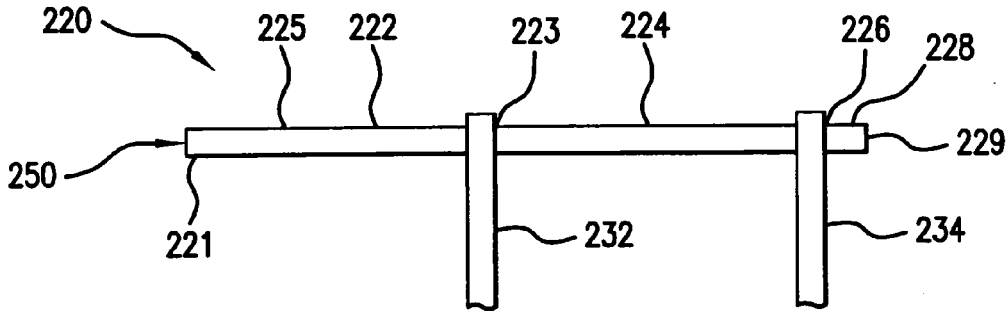
FIG. 8B illustrates a heated capillary tube, such as is included within the fluid vaporizing device of FIG. 8A.

FIG. 8B illustrates a preferred heated capillary flow passage 220 in the form of a capillary tube 225 having an inlet end 221, an outlet end 229, an upstream electrode 232 and a downstream electrode 234 connected to the capillary tube at points 223 and 226, respectively, by suitable means such as brazing or welding. The electrodes 232, 234 divide the capillary tube into an upstream feed section 222 between the inlet 221 and the first electrode 232, an intermediate heated section 224 between the first electrode 232 and the second electrode 234, and a downstream tip 228 defined between the second electrode 234 and the outlet end 229 of the capillary tube. Further details of this capillary arrangement and operation thereof are set forth in U.S. Pat. No. 6,640,050, the disclosure of which is hereby incorporated by reference.

Figure 9:
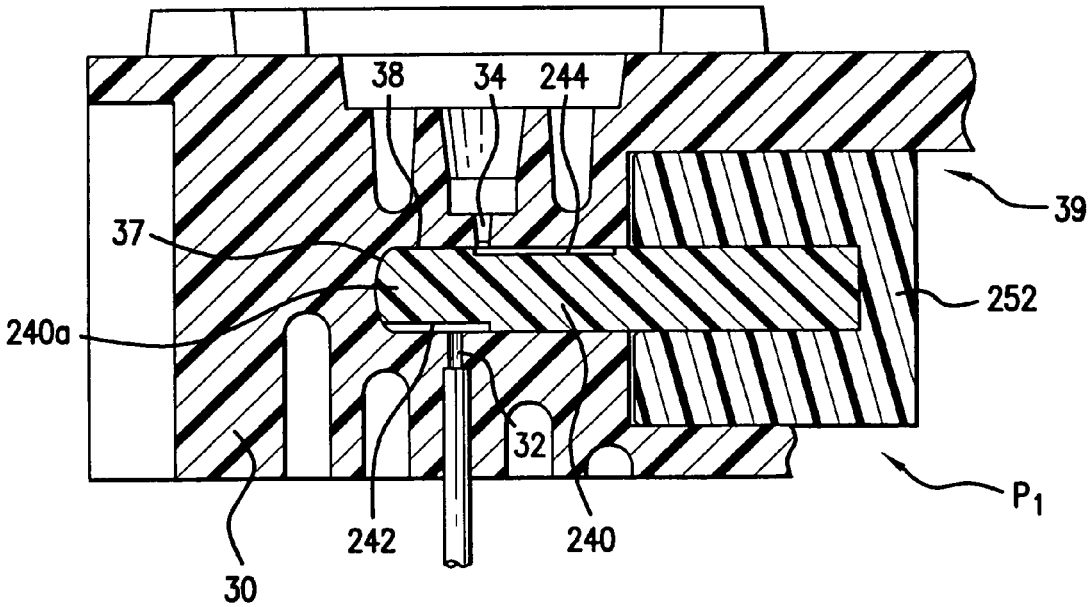
FIG. 9 illustrates an embodiment wherein a larger diameter portion of the piston is a sleeve that fits over a smaller diameter portion of the piston.

As shown in FIG. 1, the piston P of the piston pump can be a stepped piston having a smaller diameter portion 40 and a larger diameter portion 50. The smaller and larger diameter portions of the piston can be integral, or in an alternative embodiment, such as illustrated in FIG. 9, the larger diameter portion of the piston $P_1$ can be formed as a separate sleeve 252 that slides over the outer diameter of the smaller diameter piston 240. The piston P, shown in FIGS. 1–6, or piston $P_1$, shown in FIG. 9, are mounted rotatably and reciprocally in a cylinder housing 30 having a smaller diameter cylinder (i.e., a cylindrical recess) 38 and a larger diameter cylinder (i.e., a cylindrical recess) 39. According to a preferred embodiment, the smaller diameter portion of the piston 40 fits with an interference fit within the smaller diameter cylinder 38, while the larger diameter portion 50 of the piston P fits within the larger diameter cylinder 39 with or without an interference fit.

In order to allow the piston 40 to rotate and reciprocate within the cylinder 38 while providing an interference fit, materials are selected for the piston and cylinder such that one preferably has a different hardness than the other. As an example, the piston can be made from a relatively soft polymer material, such as polytetrafluoroethylene, such as sold under the trademark TEFLON®, while the cylinder is made from an injection molded polymer such as polycarbonate having a hardness that is higher than the piston. Thus, the piston is radially compressed within the cylinder to provide the interference fit. The reverse could also be implemented, with the piston being made from a relatively hard polymer or other material, and the cylinder being made from a material having a lower hardness. The selection of materials is also based on other factors including, but not limited to, manufacturability, compatibility with the fluids being pumped, durability and stability of the material in maintaining precise dimensions under a variety of operational and environmental conditions.

One inherent problem that can be encountered with a piston is the entrapment of air during the initial priming cycle. The quantity of fluid to be delivered can be extremely small, e.g., 0.0003 cubic inch. Consequently, any air that is entrapped during printing will adversely affect the accuracy and repeatability of this small delivery amount unless it is eliminated with the design. Existing piston pumps often use a tight fitting piston and cylinder, wherein the tight fit results in a 0.002–0.005 inch clearance between the piston and its cylinder wall. This has been found to be acceptable for liquids with low viscosity at operating temperatures. As the viscosity increases, corresponding pressures increase and the clearance gap becomes a fluid leak path. Usually a lip seal or packing gland is used to keep the fluid contained. Even though the fluid is contained with these secondary seals, the air in the clearance gap will be compressed, which slightly increases the delivered quantity. For large deliveries, this increase is insignificant, but with a delivery of only 0.0003 cubic inch, it creates a significant error in accuracy and dose-to-dose repeatability. In an embodiment of the present invention, entrapped air is minimized by providing an interference fit between the piston and the cylinder (no clearance gap). The piston is also forced to contact the end of the cylinder with the piston end having an identical shape to the end of the cylinder, such that at the end of its delivery stroke, the piston forces out all entrapped air. A fluid delivery groove or recess is formed in the axial direction, extending a distance along the outer periphery of the piston from the one end of the piston, and is provided with the minimal cross sectional area needed to allow the fluid to flow through the groove for a given liquid viscosity and operating temperature range.

In order to facilitate the injection molding of the cylinder housing from polymer materials such as polycarbonate while maintaining desired tolerances, the cylinder housing 30 can be provided with circumferentially extending voids 33 spaced axially along the housing to thereby minimize shrinkage after cooling the molten polymer. The voids 33 are preferably arranged such that the thicknesses of sections of the injection molded polymer throughout the cylinder housing 30 are relatively constant and thus minimize dimensional changes to the cylinder 38 after injection molding the polymer.

As shown in FIG. 1, the larger diameter portion 50 of the piston P can include a coaxial, integral extension made up of a hollow cylindrical portion 52 connected to the larger diameter portion 50, a separate extension portion 53 that can be press fit over the hollow portion 52, and a flange portion 54 having integral lugs 55*a*, 55*b* that mate with cam grooves 65*a*, 65*b* around the outer periphery of an eccentric barrel cam 60. The illustrated structure extending from larger diameter portion 50, including cylindrical portion 50, press fit portion 53 and flange 54, is only one possible arrangement for providing a piston extension to connect the piston P with lugs 55*a*, 55*b* that mate with cam grooves, or otherwise providing a means for rotating and/or reciprocating the piston P. The barrel cam 60 is rotatably mounted with its central axis A being perpendicular to the central axis of the piston. Rotation of the eccentric barrel cam around its central axis A results in the rotation and reciprocation of the piston, as the lugs 55*a*, 55*b* follow around the cam grooves 65*a*, 65*b*. A change in the axial position of the lugs 55*a*, 55*b* relative to the axis A of the barrel cam results in rotation of the piston, and an eccentric portion of the outer periphery of the barrel cam reciprocates the piston as the radial distance of the lugs from the axis A of the barrel cam is changed.

The larger diameter portion 50 can be provided with an annular groove 50*a* formed a small radial distance inward from the outer circumference of larger diameter portion 50, thereby creating an annular flap 50*b* radially outward from the groove 50*a* that acts as a lip seal against larger diameter cylinder 39. Air trapped between larger diameter portion 50, larger diameter cylinder 39 and the shoulder 35 at the intersection of larger diameter cylinder 39 and cylinder 38, will exert a radially outward force against flap 50*b* as the air is compressed, thereby improving the seal. The outer diameter of annular flap 50*b* produces a slight interference fit with the large diameter portion 39 of the cylinder. Annular groove 50*a* at the outer edge of larger diameter portion 50 produces a live hinge and some flexing to reduce friction during operation. Sealing is produced by the interference fit and can be increased for higher operating pressures by inserting a low durometer o-ring or coiled wire spring (not shown) in the annular groove 50*a* to increase friction. As the piston P moves in the cylinder with larger diameter portion 50 approaching the shoulder 35 between larger diameter cylinder 39 and smaller diameter cylinder 38, the pressure increases. This increase is felt on the face of the annular groove 50*a* and forces the flap 50*b* of larger diameter portion 50 tighter against the cylinder 39, which improves the seal. The higher the pressure is, the more effective the seal.

As further shown in FIG. 1, the smaller diameter portion 40 of the piston includes a fluid groove 42 that is formed in the outer periphery of the piston and extends in the axial direction of the piston from the end 40*a* of the piston 40. The fluid groove 42 has a cross sectional area in a plane perpendicular to the central longitudinal axis of the piston 40 such that a precise and repeatable amount of fluid will flow through the fluid groove 42 between the outer periphery of the piston 40 and the smaller diameter cylinder 38. In a preferred embodiment, the groove can be a rectangular slot about 0.005 inch deep and about 0.010 inch wide, or approximately 0.00005 $in^2$, which is believed to be a desirable cross sectional area for use with delivering a fluid containing medicament to a heated capillary flow passage in an aerosol generator. It will be recognized that a range of cross sectional areas and shapes for the groove can be provided dependent on factors that include, but are not limited to, the viscosity of the fluid, ambient temperatures in which the piston pump will be used, etc. Cross sectional areas for the groove could range from about 0.00001 $in^2$ to about 0.0005 $in^2$, as an example. The small cross sectional area of this groove, coupled with a very short stroke of the piston, enables delivery of very small amounts of fluid to a downstream component, such as approximately 5 microliters per a single stroke of the piston, and in a very precise and repeatable manner. A second groove 44 can be provided along the outer periphery of the piston 40 in a direction parallel to the central longitudinal axis of the piston 40 and at a position that is circumferentially spaced from the groove 42.

Figure 10:
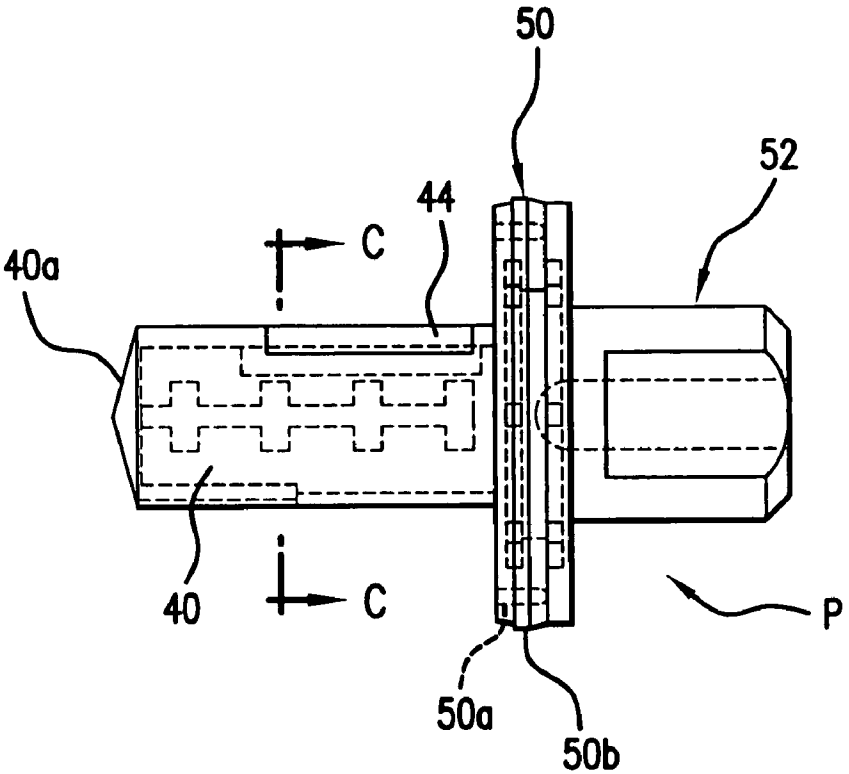
FIG. 10 illustrates a cross-sectional view of a piston according to one embodiment.
Figure 10A:
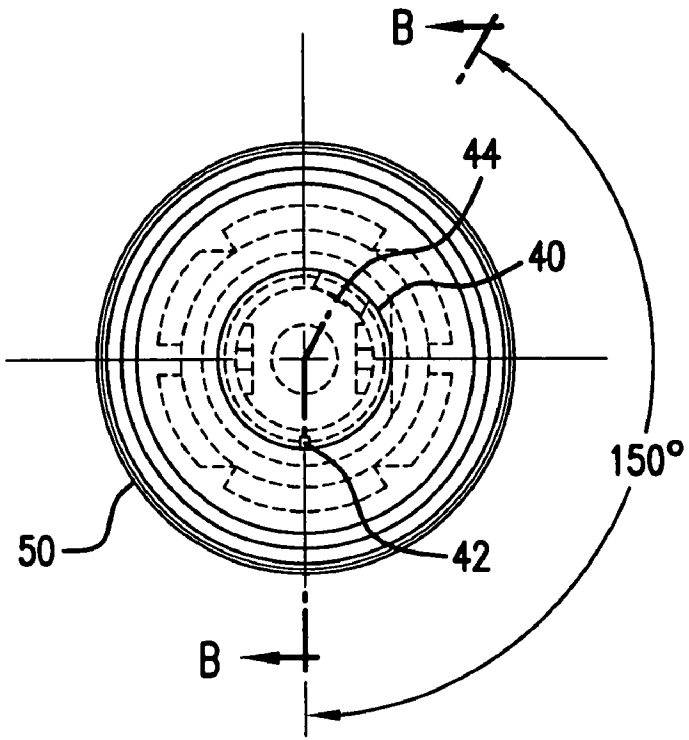
FIG. 10A illustrates an end view of the piston shown in FIG. 10.
Figure 10B:
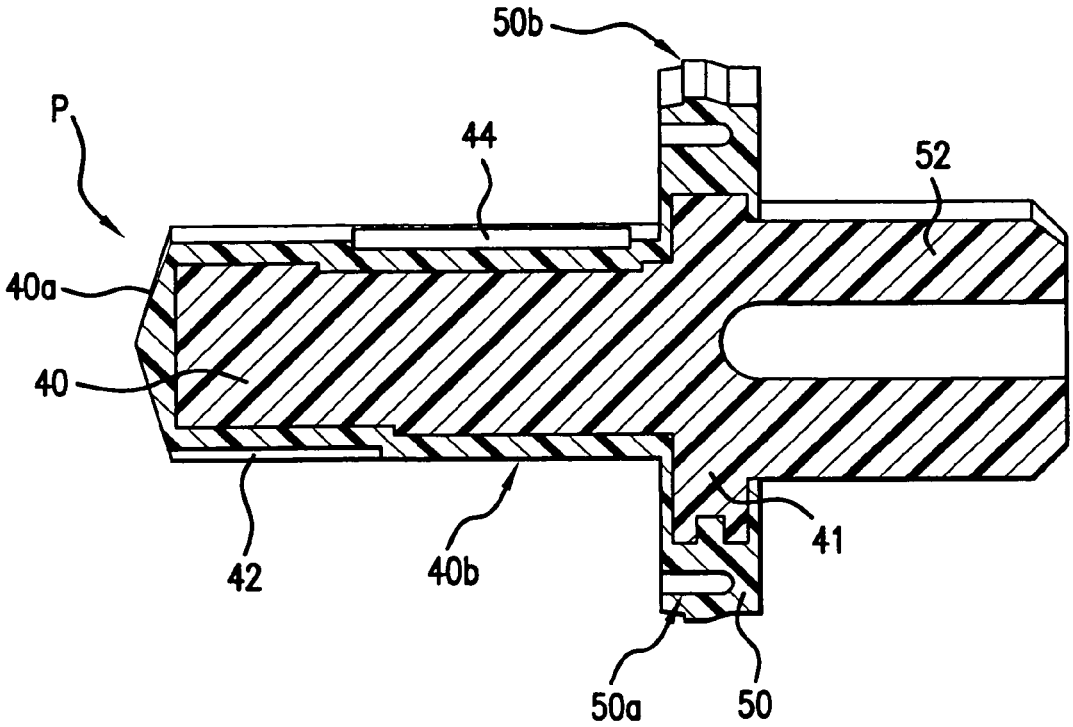
FIG. 10B is a sectional view along line B—B in FIG. 10A.
Figure 10C:
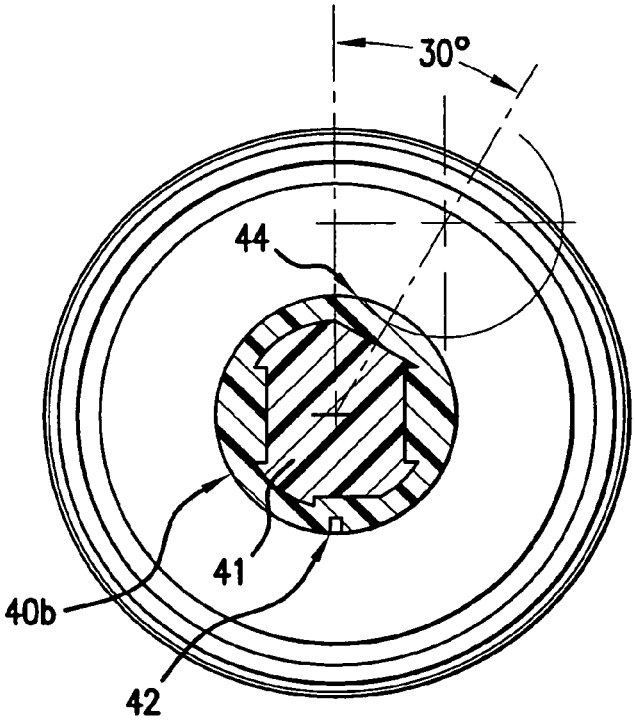
FIG. 10C is a sectional view along line C—C in FIG. 10.

FIGS. 10–10C illustrate one possible embodiment of the piston P, wherein the piston P is formed from a hard plastic core 41 that is covered, at least over the smaller diameter portion 40, with a softer polymer overmold 40*b* made from a material such as polytetrafluoroethylene, such as sold under the trademark TEFLON®. This construction allows the piston P to maintain precise overall dimensions over a range of temperatures and other operating conditions, while providing a soft enough outer surface to the smaller diameter portion 40 such that it can be compressed under the interference fit with cylinder 38. The smaller diameter portion 40, larger diameter portion 50 and extension 52 are molded as one piece in the embodiment shown in FIGS. 10–10C, with fluid delivery groove 42 on smaller diameter portion 40, and air purge groove 44, formed into the overmold 40*b* at circumferentially spaced positions. In the embodiment shown for illustration purposes, but not as a limiting example, in FIGS. 10–10C, the fluid delivery groove 42 is located 150 degrees away from the air purge groove 44. The groove 44 is also provided as a slightly convex recess along an axial extent of smaller diameter portion 40. For illustration purposes, but not in any way a limiting example, FIG. 10C shows the air pure groove 44 defined by the intersection of a circle of 0.078 inch radius, spaced on center at 0.15 inch from the center of smaller diameter portion 40, with the outer periphery of the smaller diameter portion 40 at a position 150 degrees from the fluid delivery groove 42. The fluid delivery groove 42 is shown to be a rectangular groove 0.008 inch deep and 0.006 inch wide, as one, non-limiting example.

An inlet port 32 is provided into the smaller diameter cylinder 38, and provides fluid communication between the cylinder and a reservoir received in a receptacle 25, e.g., a replaceable container of fluid can be pierced with a needle 32*a* in fluid communication with outlet 32. An exit port 34 from the smaller diameter cylinder 38 is provided in fluid communication with an attachment component such as a boss 80 for connection to a downstream component such as a heated capillary flow passage of an aerosol generator.

The stepped piston P shown in FIG. 1 can be reciprocated such that the end 40*a* of the smaller diameter piston 40 will reach the end of its travel at the end wall 37 of the smaller diameter cylinder 38, thereby delivering a precise volume of fluid to the outlet 34. The shape of end 40*a* is desirably identical to the shape of end wall 37, such that no air is entrapped between the end of piston P and cylinder 38 during a priming cycle. The larger diameter cylinder 39 forms a shoulder 35 adjacent the smaller diameter cylinder 38, and an air gap is defined between the shoulder 35 and the larger diameter portion 50 of the piston. An additional recess 36 at the intersection of the shoulder 35 and the smaller diameter cylinder 38 ensures that the groove 44 remains in fluid communication between the air gap and the exit port 34 when the groove 44 is in communication with the outlet 34 and the piston 40 reaches one end of its travel in the cylinder 38.

The stroke of the piston P in the embodiment of FIG. 1 is determined by the amount of eccentricity E (shown in FIG. 2A) on the barrel cam 60 as it is rotated about its central axis A. As the barrel cam 60 is rotated about its central axis A, the lugs 55*a*, 55*b* of the piston extension flange 54 travel within the cam grooves 65*a*, 65*b* around the outer periphery of the barrel cam 60. Rotation of the barrel cam 60 about its central axis A therefore causes rotation of the piston P within the cylinder 30 until the lugs 55*a*, 55*b* of the piston reach a dwell portion 65*a*', 65*b*' of the cam grooves defined around the outer periphery of the barrel cam 60. These dwell portions 65*a*', 65*b*' of the cam grooves extend around the eccentric portion of the barrel cam 60 at a constant axial position relative to the central axis A of the barrel cam 60. Accordingly, when the lugs 55*a*, 55*b* of the piston extension 54 reach the dwell portions 65*a*', 65*b*', the barrel cam 60 can continue to rotate without causing a rotation of the piston. Thus, the piston can then translate without rotation. The amount of eccentricity E of the barrel cam 60 in this region of the outer periphery of the barrel cam 60, or change in radial distance from the central axis A to the outer periphery of the barrel cam, determines the stroke of the piston as the barrel cam continues to rotate about axis A.

As shown in FIG. 1, the barrel cam arrangement can also include a miter gear 72 connected to or integral with one end of the barrel cam and mating with a second miter gear 74 that is connected to a cam plate 76, 78 for returning the piston in the opposite direction from which it is driven by the eccentricity of the barrel cam 60. Rotation of the barrel cam 60 causes rotation of miter gears 72, 74, and therefore cam plate 76, 78 such that a thicker portion 78 of the cam plate engages with the back surface of the piston extension flange 54 and moves the piston P to the right in FIG. 1, opposite from the direction in which it is moved by the eccentricity E of the barrel cam 60. The thicker portion 78 of the cam plate contacts the back surface of the piston extension flange 54 when the barrel cam 60 has rotated to a position wherein the lugs 55*a*, 55*b* of the piston extension 54 are within the dwell portions 65*a*', 65*b*' of the cam grooves along a smaller radius portion of the barrel cam. As a result, the piston is free to move in a direction away from the end wall 37 of the smaller diameter cylinder 38, parallel to its central axis, and toward the central axis A of the barrel cam 60, without rotating.

One of ordinary skill in the art will recognize that numerous alternative embodiments can be provided for rotating and reciprocating the piston within cylinder 30, such as using a spring to return the piston during a suction stroke rather than the cam plate 76, 78, other geared arrangements, and/or electromechanical actuators. FIGS. 7A and 7B illustrate an alternative embodiment wherein the piston 140 includes a geared end 182 that engages with a pivotally mounted rack gear 150. The rack gear 150 can be moved as a result of a manual operation, e.g., a user opening a cover on a device, such as a hand-held inhaler with a heated capillary flow passage, which may be integrated into an aerosol generator. Movement of the rack gear 150 could cause rotation of the piston to move the piston between positions wherein the fluid groove 142 is aligned with the inlet port 132, or out of alignment with the inlet port such that the inlet port is sealed by the piston 140. In the embodiment shown in FIG. 7A, fluid is pulled into the cylinder 138 through the inlet port 132 and fluid groove 142 as the piston is moved away from end wall 137 of cylinder 138 by the spring 160. The piston 140 is then rotated by movement of rack 150 in engagement with the piston gear 182 to a position wherein the inlet port 132 is sealed off by the piston 140. A cam 190, preferably driven at a precise rate of speed by an actuator (not shown), can then cause the piston 140 to move in the axial direction toward the end wall 137 of cylinder 138, thereby dispensing the fluid in the cylinder 138 through the exit port 134 located at the end wall 137 of the cylinder 138. A downstream component, such as a heated capillary flow passage 180 of an aerosol generator, then receives the precise amount of fluid dispensed from the cylinder 138. One of ordinary skill in the art will recognize that a variety of other geared or other mechanical and/or electromechanical arrangements can be provided to rotate and reciprocate the piston at the desired speed and distance to achieve the desired delivery of fluid from the reservoir to the downstream component.

Figure 3:
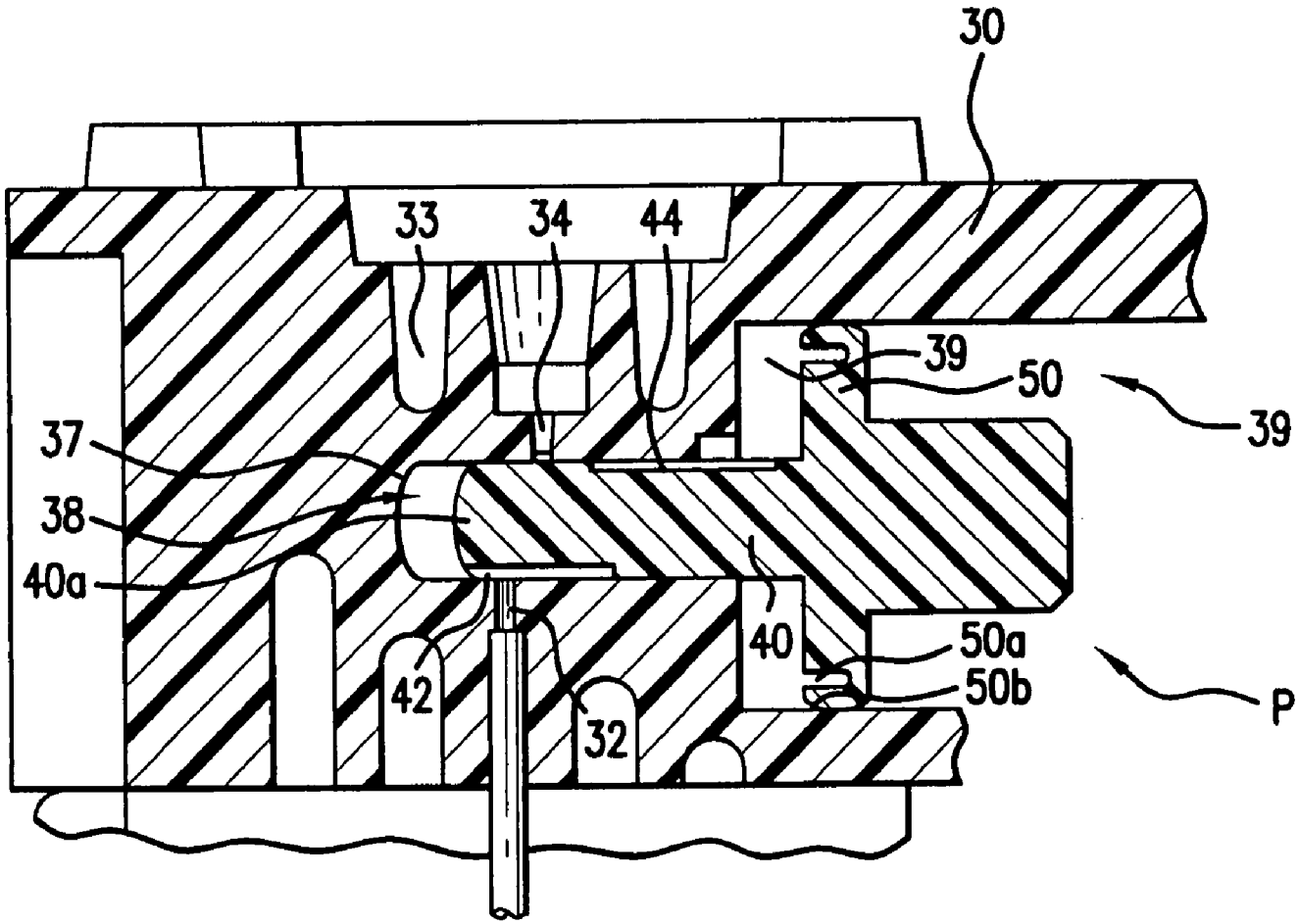
FIG. 3 is a schematic illustration of the stepped piston shown in the embodiment of FIG. 1 at the end of a suction stroke.

As shown in FIG. 3, operation of the piston pump can include moving the piston P back away from end wall 37 in cylinder 38, with the fluid groove 42 along the outer periphery of the smaller diameter piston 40 being aligned with the inlet port 32 such that the groove 42 and cylinder 38 are in fluid communication with the reservoir 25 during a suction stroke. Movement of the piston 40 away from end wall 37 is caused in the embodiment shown in FIG. 1 by the thicker portion 78 of the cam plate 76, 78 pushing against the back side of the piston extension flange 54. As shown in FIG. 3, when the piston 40 is fully back from its position at the end wall 37, with the fluid groove 42 being aligned with the inlet port 32, fluid drawn from the reservoir 25 by suction or as a result of pressurization of the fluid in the reservoir 25, fills the cylinder 38 in the chamber defined between the end 40*a* of the piston 40 and the end wall 37, and fills the fluid groove 42 that extends along the outer periphery of the piston from the end 40*a*.

In a preferred embodiment, the fluid delivery groove 42 has a very small cross section in order to define a very small passageway for the fluid to be dispensed during each stroke of the piston pump. The cross-sectional area of the fluid delivery groove is desirably selected to be the minimum area that will permit fluid of a desired viscosity to flow at the low end of a desired operating temperature range. The small size of this groove, along with the feature that the piston 40 can be seated flush to the end wall 37 of cylinder 38, ensures that the amount of air in the system after a priming cycle is preferably less than 1% of the volume of fluid to be dispensed during a stroke of the piston. Preferably, any remaining trapped air is removed from the chamber defined between end wall 37 and the end 40*a* of piston 40, and from the groove 42 prior to or during normal operation of the piston pump.

Figure 4:
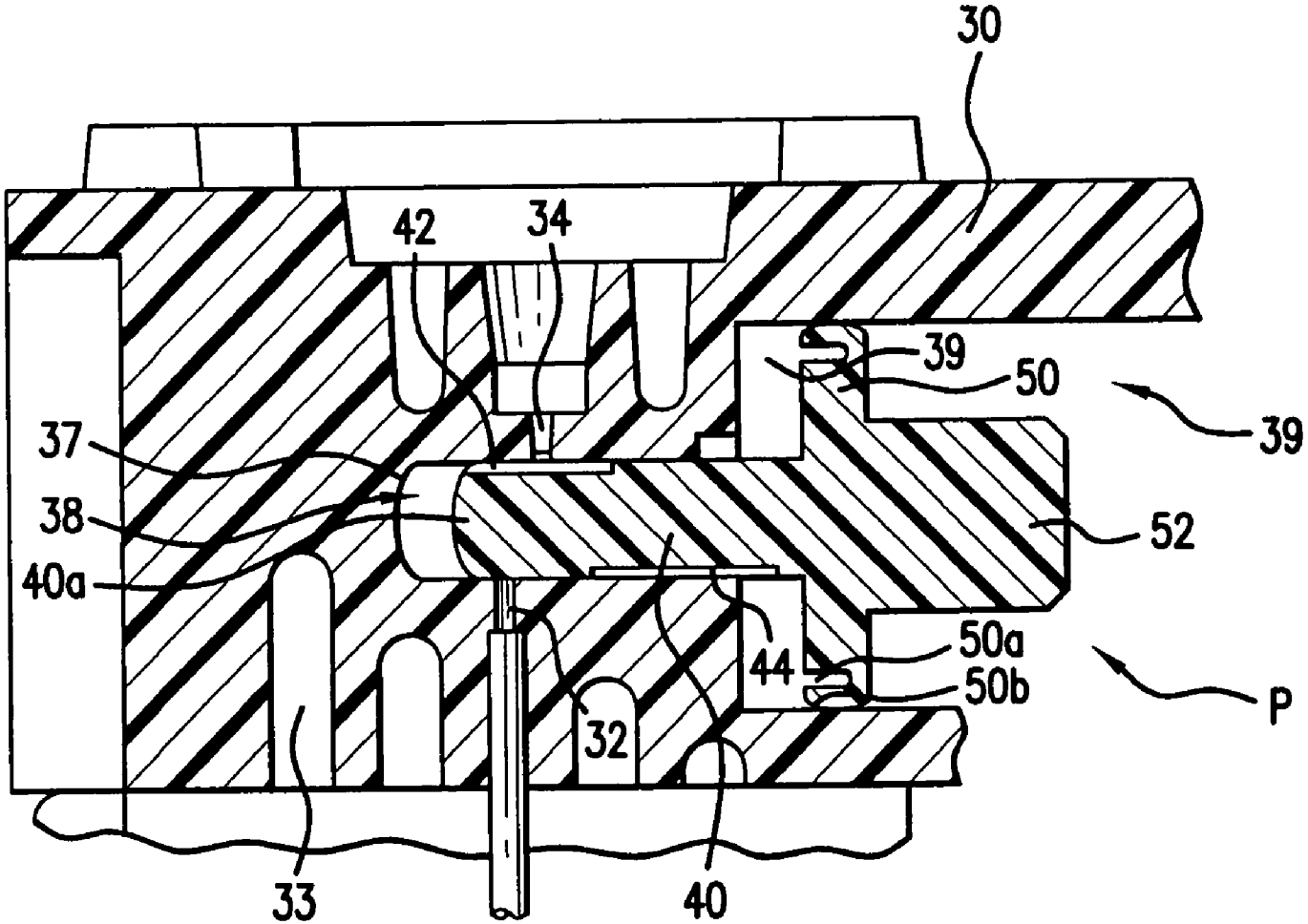
FIG. 4 is a schematic illustration of the stepped piston of the embodiment shown in FIG. 1, rotated to a position where the fluid groove is aligned with the exit port.

Referring to FIG. 4, after the piston 40 has been moved all the way back from end wall 37, and the cylinder 38 and fluid groove 42 are filled with fluid from the reservoir 25, the piston 40 is rotated to a position where the fluid groove 42 is aligned with the exit port 34, i.e., the piston rotates without translation.

Figure 5:
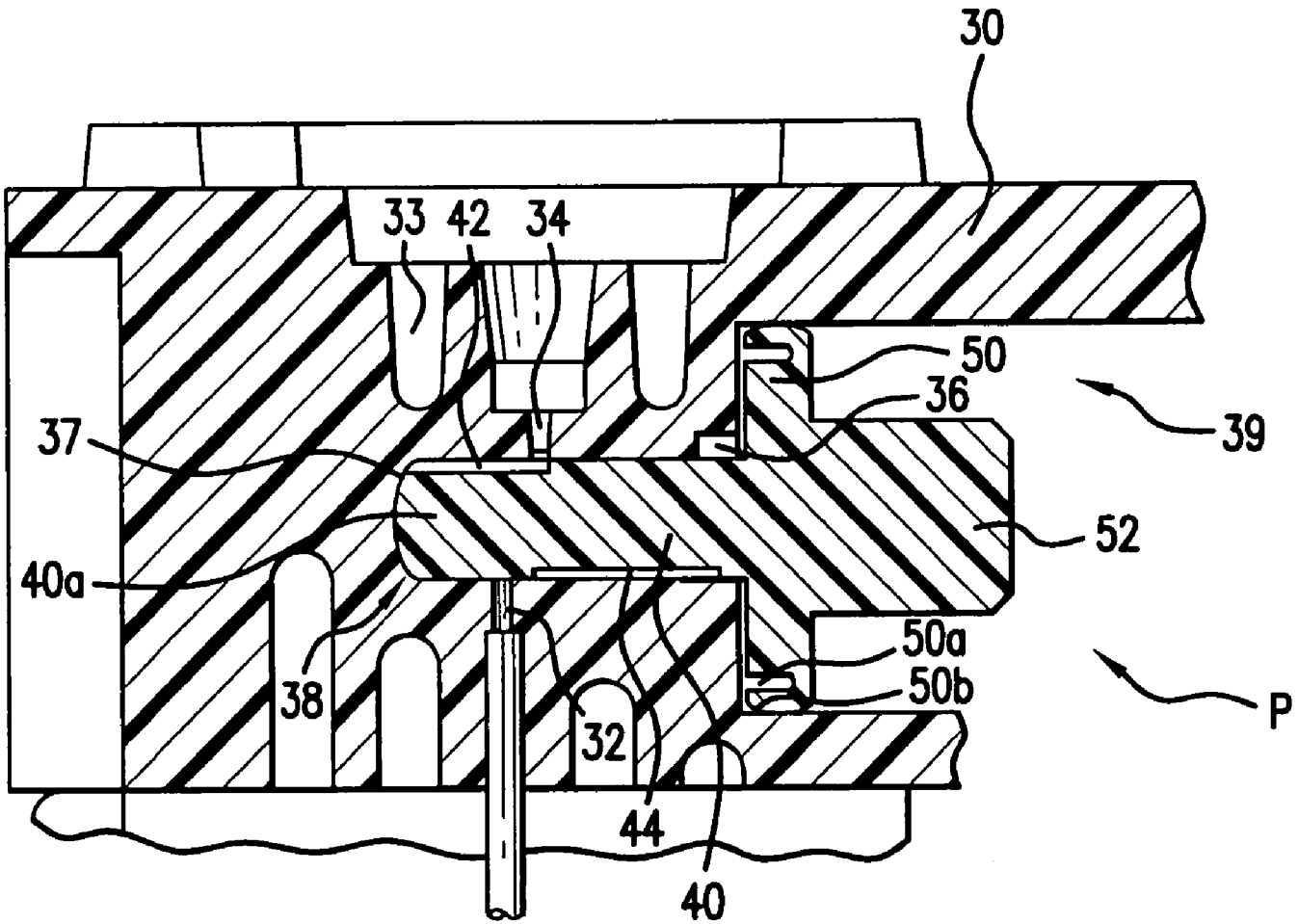
FIG. 5 is a schematic illustration of the stepped piston shown in FIG. 4, at the end of a dispensing stroke with the end of the smaller diameter portion of the piston having reached the closed end of the smaller diameter cylinder.

As shown in FIG. 5, the piston 40 is then moved forward by the distance of the stroke of the piston until the piston is flush against the end wall 37 of the cylinder 38 and a volume of fluid has passed through the groove 42 and out the exit port 34. It will be appreciated that the length of groove 42 should be selected such that some portion thereof is always in fluid communication with exit port 34 during the discharge stroke of piston 40.

Movement of the smaller diameter piston 40 and larger diameter piston 50 fully forward to the position shown in FIG. 5 also results in compression of the air trapped in recess 36 and between the larger diameter piston 50 and shoulder 35 of the larger diameter portion of the cylinder 39.

Figure 6:
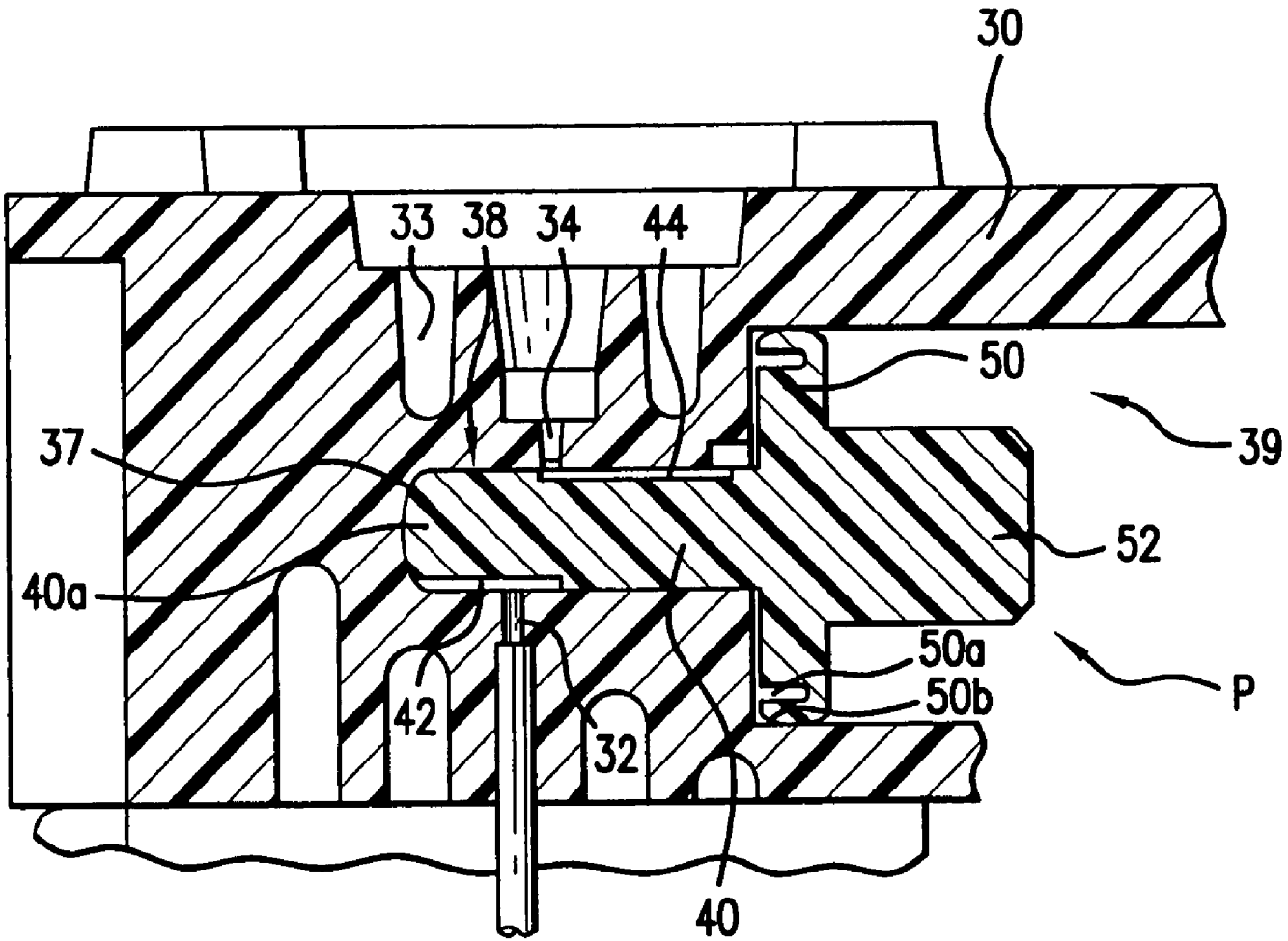
FIG. 6 is a schematic illustration of the stepped piston shown in FIG. 5, where the piston has now been rotated to a position where the second circumferentially spaced groove is aligned with the exit port of the cylinder and the fluid groove is again aligned with the inlet port of the cylinder.

As shown in FIG. 6, rotation of the piston 40 with end 40*a* of the piston 40 flush against end wall 37 of cylinder 38 then moves the fluid groove 42 from the exit port 34 back to the inlet port 32 while placing the groove 44 in communication with exit port 34 with the result that compressed air escapes from the groove 44 through exit port 34 and serves to purge any remaining fluid within the exit port in between dispensing cycles of the piston pump. In an alternative embodiment shown in FIG. 9, the larger diameter portion of the piston can be provided as a sleeve 252 that slides over the smaller diameter piston 240, thereby allowing for a larger volume of air to be compressed and fed through air purge groove 244 for purging the exit port 34 when the end 240*a* of smaller diameter piston 240 is flush against end wall 37 of cylinder 38, and air purge groove 244 is aligned with exit port 34.

Priming of the piston pump is achieved during the sequence of events shown in FIGS. 3–5, as the fluid groove 42 and chamber 38 are first filled with fluid from the reservoir 25, the groove 42 is rotated to a position in alignment with the exit port 34, and then the piston 40 is moved so that end 40*a* is flush against the end 37 of the cylinder 38 in order to dispense a volume of fluid from the exit port 34. The very small passageway through the fluid groove 42 in combination with the feature of the piston 40 moving all the way to the end 37 of cylinder 38 enables nearly complete elimination of any trapped air within the cylinder 38 such that any air remaining after a priming cycle is preferably 1% or less of the delivered volume of fluid. Alternatives to the embodiments shown in FIGS. 1–6, in which air is compressed by a stepped piston and then communicated through an air groove 44 to the exit port 34, could include an arrangement wherein the air groove is aligned with the exit port 34 during a suction stroke as the piston 40 is moved away from end wall 37 of cylinder 38 such that purge air is pulled in through the exit port 34. However, this arrangement may not be ideal in situations where the piston pump is used to deliver precise quantities of a medicament through the exit port 34 to a heated capillary flow passage of an aerosol generator. Other alternatives could include pulling air into the chamber formed between larger diameter piston 50 and shoulder 35 from a side hole into the chamber during a suction stroke as the piston is moved away from the closed end of the cylinder.

While the invention has been described in detail with reference to specific embodiments thereof, it will be apparent to those skilled in the art that various changes and modifications can be made, and equivalents employed, without departing from the scope of the appended claims.

The invention claimed is:

1. A device useful for transferring quantities of a fluid from a reservoir to a downstream component, comprising:

a cylinder housing having an axially extending cylindrical recess therein;

a piston rotatably and reciprocally mounted within the cylindrical recess, the outer periphery of said first piston forming an interference fit with the inner periphery of said cylindrical recess;

at least one groove in the outer periphery of said first piston, said groove extending parallel to the axial direction of said piston;

said having an inlet port adapted to provide fluid communication between an inlet and said at least one groove when said piston is in a first position, and an exit port spaced from said inlet port providing fluid communication between said at least one groove and an outlet when said piston is rotated to a second position, and said piston moves to drive fluid out of said outlet; and a piston drive mechanism arranged to rotate the piston without translation thereof, and to translate the piston without rotation thereof.

2. The device according to claim 1, wherein said cylinder housing comprises an injection molded body of a polymeric material.

3. The device according to claim 1, wherein said at least one groove is a rectangular groove approximately 0.005 inch deep and approximately 0.010 inch wide.

4. The device according to claim 1, wherein said at least one groove comprises a plurality of grooves, and wherein:

a first one of said grooves is formed in the outer periphery of said piston at a first circumferential position, and a second one of said grooves is formed in the outer periphery of said piston at a second circumferential position different from said first position.

5. The device according to claim 4, wherein:

said first and second grooves are offset relative to each other in the axial direction of said piston.

6. The device according to claim 1, wherein said piston is stepped, with a larger diameter portion of said piston fitting within a larger diameter portion of said cylindrical recess, and a smaller diameter portion of said piston fitting within a smaller diameter portion of said cylindrical recess.

7. The device according to claim 6, wherein said at least one groove is formed in the outer periphery of said smaller diameter portion of said piston.

8. The device according to claim 6, wherein said at least one groove includes an air purge groove, and said larger diameter portion of said piston and said larger diameter portion of said cylindrical recess together define a volume in fluid communication with said air purge groove when said air purge groove is in fluid communication with said exit port.

9. The device according to claim 1, wherein the piston constitutes a first piston, and the cylindrical recess constitutes a first cylindrical recess, the device further comprising:

a second piston coaxial with said first piston and having a larger outer diameter than said first piston, said second piston forming a sleeve over the outer periphery of said first piston and being reciprocally mounted within a second cylindrical recess in the cylinder housing, said second cylindrical recess having a larger inner diameter than said first cylindrical recess.

10. The device according to claim 9, wherein one end of said second cylindrical recess forms a shoulder adjacent one end of said first cylindrical recess, with a volume being defined between said shoulder and said second piston when the second piston is spaced from the shoulder, and said volume being in fluid communication with an air purge groove when said air purge groove is in fluid communication with said exit port.

11. The device according to claim 10, wherein said at least one groove comprises first and second grooves, the first groove being in the outer periphery of said first piston at a first circumferential position, and the second groove being in the outer periphery of said first piston at a second circumferential position different from said first position.

12. The device according to claim 11, wherein downstream ends of said first and second grooves are offset relative to each other in the axial direction of said first piston.

13. The device according to claim 1 in combination with a reservoir communicating with the inlet port and containing a liquid having medicament therein, and an aerosol generator comprising a heated capillary flow passage located downstream of the exit port.

14. The piston pump according to claim 1 wherein the piston drive mechanism comprises a cam member movable relative to the piston and operably connected to the piston by a cam groove-and-lug arrangement, the cam groove configured to produce, in response to movement of the cam member relative to the piston, the rotation of the piston without translation, and the translation of piston without rotation as the lug travels along the cam groove.

15. The piston pump according to claim 14 wherein the cam groove is formed in the cam member.

16. The piston pump according to claim 15 wherein the cam member comprises a barrel cam rotatable relative to the piston for producing travel of the lug within the groove.

17. A piston pump for pumping fluid from a reservoir to a downstream component, said piston pump comprising:

a piston mounted rotatably and reciprocally within a cylindrical recess, said piston having a larger diameter portion fitted in a larger diameter portion of said cylindrical recess, and a smaller diameter portion fitted with an interference fit within a smaller diameter portion of said cylindrical recess, said piston having a first fluid groove formed in an axial direction of said piston along the outer periphery of said smaller diameter portion of said piston at a first circumferential position, said first fluid groove extending from an end of said piston part way along the outer periphery of said piston, and said piston further including a second fluid groove formed in an axial direction of said piston along the outer periphery of said smaller diameter portion of said piston at a second circumferential position different than said first circumferential position and at least partially offset in the axial direction of said piston from said first fluid groove, the second fluid groove comprising an air purge groove.

18. The piston pump according to claim 17, wherein an inlet port adapted to be in fluid communication with a reservoir is formed into said smaller diameter portion of said cylindrical recess at a first circumferential position, and an exit port in fluid communication with a downstream component is formed into said smaller diameter portion of said cylindrical recess at a second circumferential position, said first fluid groove providing fluid communication between said inlet port and said smaller diameter portion of said cylindrical recess during a suction stroke of said piston, and between said exit port and said smaller diameter portion of said cylindrical recess during a dispensing stroke of said piston, and said second purge groove providing fluid communication between an exit port and a compressed gas chamber formed between said larger diameter portion of said piston and said larger diameter portion of said cylindrical recess, when said piston is flush against one end of said smaller diameter portion of said cylindrical recess and said first fluid groove is aligned with said inlet port.

19. The piston pump according to claim 17, wherein said larger diameter portion of said piston is integral with said smaller diameter portion of said piston.

20. The piston pump according to claim 17, wherein said larger diameter portion of said piston comprises a sleeve that is fitted over the outer periphery of said smaller diameter portion.

21. The piston pump according to claim 14, wherein said piston includes an extension having at least one lug, and a barrel cam is provided for rotation about an axis perpendicular to the central axis of said piston, said barrel cam including at least one cam groove around its outer periphery with said at least one lug being engaged with said at least one cam groove, and said barrel cam further including an eccentric portion wherein the eccentricity of said eccentric portion is substantially equal to the desired stroke of said piston.

22. The piston pump according to claim 21, wherein:

a cam plate is provided in contact with said piston extension on a surface of said piston extension opposite from said at least one lug, said cam plate being rotated by the rotation of said barrel cam such that a thicker portion of said cam plate contacts said piston extension when said at least one lug is engaged with said at least one cam groove at a region of the outer periphery of said barrel cam other than at said eccentric portion, whereby said piston is driven in a first axial direction by said eccentric portion of said barrel cam and in the opposite axial direction by said cam plate.

23. The piston pump according to claim 22, wherein a first miter gear is fixed to said barrel cam for rotation with said barrel cam around the central axis of said barrel cam, and a second miter gear fixed to said cam plate is engaged with said first miter gear for rotation about an axis perpendicular to the central axis of said barrel cam.

24. The piston pump according to claim 17, wherein said larger diameter portion comprises an annular groove positioned radially inward from the outer diameter of the larger diameter portion and defining a flexible annular flap or lip seal around the outer periphery of the larger diameter portion.

25. A piston pump useful for transferring quantities of a fluid from a reservoir to a downstream component, comprising:

a cylinder housing having an axially extending cylindrical recess therein;

a piston rotatably and reciprocally mounted within the cylindrical recess, the outer periphery of said piston forming an interference fit with the inner periphery of said cylindrical recess, at least one groove in the outer periphery of said piston, said groove extending in an axial direction of said piston, and said cylindrical recess having an inlet port adapted to provide fluid communication between an inlet and said at least one groove when said piston is in a first position, and an exit port spaced from said inlet portion providing fluid communication between said at least one groove and an outlet when said piston is rotated to a second position, and said piston moves to drive fluid out of said outlet, wherein said piston is stepped, with a larger diameter portion of said piston fitting within a larger diameter portion of said cylindrical recess, and a smaller diameter of said piston filling within a smaller diameter portion of said cylindrical recess, wherein said at least one groove includes an air purge groove, and said larger diameter portion of said piston and said larger diameter portion of said cylindrical recess together define a volume in fluid communication with said air purge groove when said air purge groove is in fluid communication with said exit port.

26. Apparatus useful for transferring quantities of a fluid having medicament therein from a reservoir to a downstream aerosol generator comprising:

a cylinder housing having an axially extending cylindrical recess therein;

a piston rotatably and reciprocally mounted within the cylindrical recess, the outer periphery of said piston forming an interference fit with the inner periphery of said cylindrical recess.

at least one groove in the outer periphery of said piston, said groove extending in an axial direction of said piston, said cylindrical recess having an inlet port adapted to provide fluid communication between an inlet and said at least one groove when said piston is in a first position, and an exit port spaced from said inlet portion providing fluid communication between said at least one groove and an outlet when said piston is rotated to a second position, and said piston moves to drive fluid out of said outlet, a reservoir communicating with the inlet port and containing a liquid having medicament therein, and an aerosol generator comprising a heated capillary flow passage communicating with the exit port downstream thereof.

* * * * *